United States Patent [19]

Blyakharov

[11] 4,380,123

[45] Apr. 19, 1983

[54] TOOL FOR OPENING A CAN OR THE LIKE

[76] Inventor: Ayzik Blyakharov, 31-77 32 St., Astoria, N.Y. 11106

[21] Appl. No.: 46,565

[22] Filed: Jun. 7, 1979

[51] Int. Cl.[3] ..... B67B 7/30

[52] U.S. Cl. ..... 30/409; 30/413

[58] Field of Search ..... 30/409, 413, 429, 430

[56] References Cited

U.S. PATENT DOCUMENTS

| | | | |
|---|---|---|---|
| 922,117 | 5/1909 | Favorite | 30/409 |
| 1,082,800 | 12/1913 | Darqué | 30/429 |
| 4,300,288 | 11/1981 | Blyakharov et al. | 30/409 |

FOREIGN PATENT DOCUMENTS

| | | | |
|---|---|---|---|
| 430651 | 10/1911 | France | 30/429 |
| 600591 | 4/1948 | United Kingdom | 30/429 |

*Primary Examiner*—James G. Smith
*Assistant Examiner*—Debra S. Meislin
*Attorney, Agent, or Firm*—Ilya Zborovsky

[57] ABSTRACT

A tool for opening of a can or the like has a first portion and a second portion extending transversely to each other. The second portion has a pointed tip and a cutting edge, whereas the first portion has a cutout with an outlet which is open at the second portion. The second portion partially overlaps and laterally limits the outlet of the cutout of the first portion. When the tool is placed onto a bead of a can, one wall section of the cutout is supported on the bead, and a wall of the can is firmly clamped between another wall of the cutout of the first portion and an overlapping section of the second portion. Thereby, a very clean cut is obtained and a small force is needed for cutting through a cover of the can. Two such second portions may be provided, one of which second portion is suitable for cutting by a right-handed person, whereas the other of said second portions is suitable for cutting by a left-handed person.

10 Claims, 7 Drawing Figures

FIG. 1
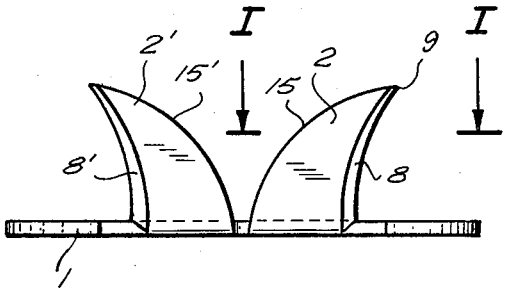
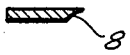
FIG. 4
FIG. 3
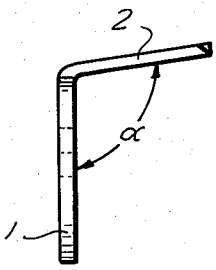
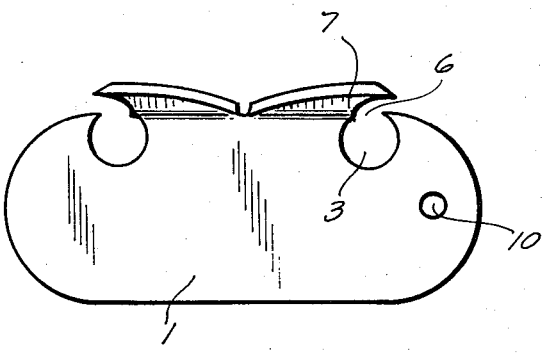
FIG. 2

FIG. 5
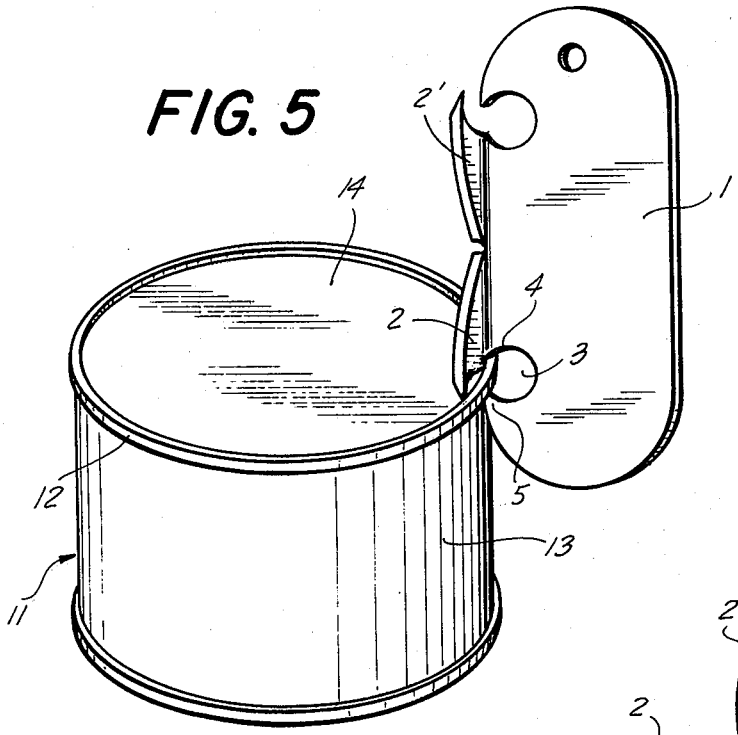
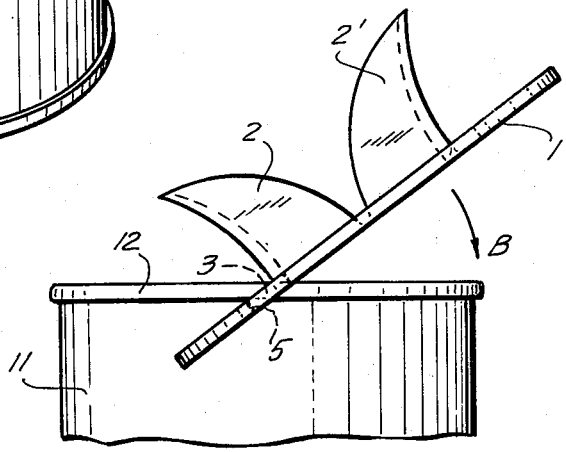
FIG. 6
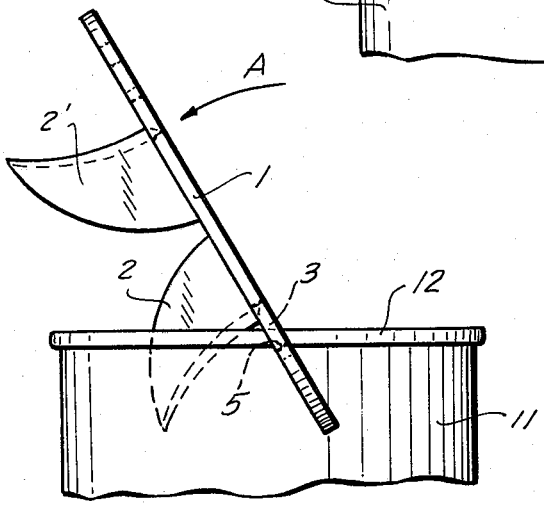
FIG. 7

TOOL FOR OPENING A CAN OR THE LIKE

BACKGROUND OF THE INVENTION

The present invention relates to a tool for opening a can or the like, and more particuraly to a can opener.

Tools for opening cans or the like are known in the art and widely utilized in household. They effectively serve their purposes. However, at the same time they possess some disadvantages. A surface of a wall of the can which is opened is not smooth inasmuch as a plurality of small projections remains after cutting. These projections are very sharp and therefore dangerous for a user. At the same time the projections worsen appearance of the opened can. On the other hand, it is not easy to open a can by a hand-operated can opener. First of all, the known can opener is not reliably held or clamped on a can to be opened whereby additional efforts must be applied for firmly holding the can opener in order to prevent its tilting or displacement. Second of all, a substantially high force must be applied for opening a can or the like, which makes the opening process very difficult and even impossible for some users, such as children. In addition to the above-mentioned considerations, the known hand-operated can openers have a complex construction and are not easy to manufacture. Since a high force is required to be applied, the known hand-operated can openers are generally provided with elongated handle in order to obtain amplification of force applied by a user. Finally, the known can openers are not convenient for both a left-handed and a right-handed person.

SUMMARY OF THE INVENTION

Accordingly, it is an object of the present invention to provide a tool for opening a can or the like, which avoids the disadvantages of the prior art.

More particularly, it is an object of the present invention to provide a tool which has a simple construction, provides for a clear cut and is easy to operate.

Still another feature of the present invention is to provide a tool which requires a relatively small force to be applied and is guided during the process of cutting so that it is not to be firmly held to prevent tilting or canting.

A further object of the present invention is to provide a tool which is convenient to operate by both a left-handed person and a right-handed person.

In keeping with these objects and with others which are considered to be characteristic for the present invention, one feature of the present invention resides, briefly stated, in that a tool has two transversely located portions one of which has a cutout with an outlet, whereas the other portion partially overlaps and laterally limits the outlet of the cutout, so that when a tool is placed onto a can one wall section bounding a cutout is supported on a bead of the can, and a wall of the can is firmly held or clamped between the other wall section bounding the cutout and a section of the second portion which laterally limits the cutout.

In such a construction a smooth and clean cut is produced inasmuch as the wall of the can is firmly clamped by the tool. At the same time, the tool is reliably held on the can during the cutting process whereby no additional effort are required in holding the same to prevent tool tilting or canting. A relatively small force is required for opening a can or the like. The operation of the inventive tool is very convenient.

Another feature of the present invention is that two second portions with oppositely facing cutting edges are provided. In such a construction the tool is convenient to operate for both a left-hand person and a right-handed person.

The novel features which are considered characteristic for the present invention are set forth in the appended claims. The invention itself, however will be best understood, together with the additional objects and advantages, from the following description when read in connection with the drawings accompanying the latter.

BRIEF DESCRIPTION OF THE DRAWING

FIG. 1 is an elevational view of a tool for opening a can or the like, in accordance with the present invention;

FIG. 2 is a plane view of the inventive tool shown in FIG. 1;

FIG. 3 is a side view of the inventive tool shown in FIGS. 1 and 2;

FIG. 4 is a view showing a section of a cutting edge of the tool of FIG. 1;

FIG. 5 is a side view of a can on which the inventive tool is placed so as to start the process of opening the can;

FIG. 6 is a view showing the inventive tool placed on the can, in slightly withdrawn position before making a next cut; and FIG. 7 is a view showing the inventive tool placed on the can in a position in which its portion cuts through a cover of the can so as to open the latter.

DESCRIPTION OF A PREFERRED EMBODIMENT

A tool for opening a can or the like has a first portion which is identified by reference numeral 1 and a second portion which is identified by reference numeral 2. The above-mentioned portions together form an integral member.

The first portion 1 extends in one plane, whereas the second portion extends in another plane. Advantageously, these planes are inclined relative to one another by an angle which is somewhat greater than 90°. This can be seen particularly in FIG. 3. The first portion 1 and the second portion 2 extend in a direction of elongation of the first portion, as can be seen particularly in FIGS. 1 and 2, as considered in respective planes in which these portions are located.

The first portion 1 has a cutout 3 bounded by a wall having two wall sections 4 and 5 which are spaced from one another in the direction of elongation of the first portion 1. The cutout 3 has an outlet 6 which is partially overlapped by a wall section 7 of the second portion 2. The second portion 2 has a cutting edge 8 which extends from the region adjacent to the first portion 1 up to a pointed tip 9. The cutting edge 8 is curved and advantageously has a concave cross section, as shown in FIG. 4. A hole 10 serves for suspension.

The operation of the inventive tool is illustrated in FIGS. 5–7. As shown in FIG. 5, the tool is so placed onto a bead 12 of a can 11 that the wall section 4 is supported on an upper surface of the bead 12. At the same time, a wall 13 of the can is firmly clamped between the wall section 5 of the first portion 1 and the wall section 7 of the second portion 2 from outside and from inside, respectively. In order to attain this clamping action, the wall section 5 extends, in a direction transverse to the direction of elongation of the first portion 1, up to the plane in which the second portion 2 extends. Then, the tool is forced by a user in the direction of arrow A, and the second portion 2 cuts through a cover 14 of the can 11. First, the tip 9 gets through the cover 14 and thereafter the cutting edge 8 enlarges the thus-formed cut. Advantageously, the tool is inclined during this step to such extent that a rear edge of the wall section 5 abuts against the bead 12 from below so that the tool is supported by the wall section 5 to the bead. Supporting of the tool by the wall section 4 on the bead, clamping the can wall 13 between the wall sections 5 and 7, and abutment of the wall section 5 against the bead from below result in obtaining a very clean cut without inner wire-edges, in guidance of the tool during the cutting process, and in convenience in operation. The inner surface of the can wall after opening of the can is completely smooth. At the same time, a force which must be applied to the tool is substantially reduced.

After the first cut the tool is moved in the direction of arrow B so that the second portion is somewhat withdrawn from the cut. It can be completely withdrawn from the cut, as shown in FIG. 6 so that the opposite edge which is a front edge, of the wall section 5 abuts against the bead 12 of the can 11 from below. By successive movement of the tool in the directions of arrows A and B the cover 14 is cut completely and removed from the can 11.

As can be seen from the drawing, an additional second portion 2' may be provided. The additional second portion 2' is not identical to the second portion 2 in that it has a cutting edge 8' which faces in a direction opposite to the direction in which the cutting edge 8 of the second portion 2 faces. This means that one of the second portions may be utilized for cutting by a left-handed person, whereas the other second portion is utilized for cutting by a right-handed person. The cutting edges 8 and 8' diverge in directions away from one another. The second portions 2 and 2' have proximal edges 15 and 15', respectively, which are not cutting edges. The proximal edges 15 and 15' are located adjacent to one another in the region of the first portion 1 and diverge from one another in two opposite directions.

It will be understood thate each and every of the above-described elements may also find a useful application in other types of constructions differing from the type described above. Various modifications and structural changes may be made without departing from the spirit of the present invention. Others by applying current knowledge can adapt it for various modifications and applications.

What is claimed as desired to be protected by Letters Patent is set forth in the appended claims.

1. A tool for opening a can or the like, comprising a body part formed as an integral member and including a first portion extending in a first plane and a second portion extending in a second plane which is substantially transverse to said first plane, said first portion being elongated in a first direction and having a wall which bounds two cutouts spaced from one another in the direction of elongation and each having an outlet which opens at said second plane, each of said cutouts being bounded by a first wall section and a second wall section formed in said wall and spaced from one another in the direction of elongation, said second portion being also elongated in said first direction and having two pointed tips and two cutting edges which are located in said second plane, spaced from one another in the direction of elongation and face in opposite directions so that they can be utilized for opening by a left-handed person and a right-handed person, respectively, said second portion having two further wall sections which partially overlap and laterally limit the respective outlets of said cutouts of said first portion, so that when the body part is placed onto a bead of a can or the like and the bead is received in one of said cutouts, the first portion of said body part is supported on the bead from above by a respective one of said first wall sections, whereas a wall of the can or the like is firmly clamped between a respective one of said second wall sections of said first portion and a respective one of said further wall sections of said second portion of said body part, and when the second portion is forced into a cover of the can or the like said one second wall section of said first portion abuts against the bead from below.

2. A tool as defined in claim 1, wherein each of said second wall sections abutting against the bead from below is semi-circular, each of said first wall sections supported on the bead from above being also semi-circular, so that each of said cutouts is circular, each of said second wall sections being sharp.

3. A tool as defined in claim 1, wherein said portions have a common transverse axis of symmetry extending transverse to the direction of elongation, said cutting edges being symmetrical relative to said transverse axis of symmetry and located at opposite sides of the latter.

4. A tool as defined in claim 1, wherein said cutting edge of said second portion of said body part is curved, starting from said further section and up to said pointed tip.

5. A tool as defined in claim 1, wherein said cutting edge has a concave cross section.

6. A tool as defined in claim 1, wherein said cutting edges diverge from one another in a direction away from said first portion.

7. A tool as defined in claim 6, wherein said cutting edges are curved.

8. A tool as defined in claim 1, wherein said cutting edges both extend in said second plane and are substantially flat.

9. A tool as defined in claim 8, wherein said first plane and said second plane are inclined relative to one another by an angle which somewhat exceeds 90°.

10. A tool as defined in claim 1, wherein said first portion of said body part is flat.

* * * * *